US009562686B2

(12) United States Patent
San Miguel Arenaza

(10) Patent No.: US 9,562,686 B2
(45) Date of Patent: Feb. 7, 2017

(54) GAS VALVE ASSEMBLY

(71) Applicant: COPRECITEC, S.L., Aretxabaleta (ES)

(72) Inventor: Aitor San Miguel Arenaza, Aretxabaleta (ES)

(73) Assignee: Coprecitec, S.L., Aretxabaleta (ES)

( * ) Notice: Subject to any disclaimer, the term of this patent is extended or adjusted under 35 U.S.C. 154(b) by 319 days.

(21) Appl. No.: 14/071,933

(22) Filed: Nov. 5, 2013

(65) Prior Publication Data

US 2015/0037740 A1 Feb. 5, 2015

(30) Foreign Application Priority Data

Aug. 2, 2013 (ES) ..... 201330972 U

(51) Int. Cl.

| | |
|---|---|
| ***F24C 3/00*** | (2006.01) |
| ***F23N 5/24*** | (2006.01) |
| ***F23N 1/00*** | (2006.01) |
| ***F23N 5/10*** | (2006.01) |

(52) U.S. Cl.

CPC ..... *F23N 5/245* (2013.01); *F23N 1/005* (2013.01); *F23N 5/105* (2013.01); *F23N 2035/14* (2013.01); *F23N 2035/18* (2013.01)

(58) Field of Classification Search

CPC ..... F23N 5/245; F23N 1/005; F23N 5/105; F23N 2035/14; F23N 2035/18

USPC ..... 122/14.21; 431/18

See application file for complete search history.

(56) References Cited

U.S. PATENT DOCUMENTS

| | | | | |
|---|---|---|---|---|
| 4,505,253 | A | 3/1985 | Mizuno et al. | |
| 5,525,771 | A * | 6/1996 | Lund | H01H 3/0206 200/61.86 |
| 6,634,351 | B2 | 10/2003 | Arabaolaza | |
| 2005/0170302 | A1 * | 8/2005 | Ayastuy | F23N 1/00 431/75 |

(Continued)

FOREIGN PATENT DOCUMENTS

| | | |
|---|---|---|
| DE | 2123458 | 11/1972 |
| EP | 1113227 A2 | 7/2001 |

(Continued)

*Primary Examiner* — Avinash Savani
*Assistant Examiner* — Rabeeul Zuberi
(74) *Attorney, Agent, or Firm* — Edell, Shapiro & Finnan LLC

(57) ABSTRACT

An assembly for controlling the flow of a gas to a gas burner. The assembly including a rotational regulating valve and an electromagnetic safety valve. The regulating valve is rotational between a first angular position corresponding to a closed position and a second angular position corresponding to an open position. The safety valve includes a valve member that translates axially between a first axial position corresponding to a closed position and a second axial position corresponding to an open position. An operating shaft is operably coupled to the rotational regulating valve and to the electromagnetic safety valve and is rotatable between angular positions corresponding to the closed and open positions of the rotational regulating valve and is axially translatable between axial positions corresponding to the closed and open positions of the valve member of electromagnetic safety valve, axial translation of the operating shaft is not permitted when the angular position of the operating shaft corresponds to an open position of the rotational regulating valve.

3 Claims, 9 Drawing Sheets

(56) References Cited

U.S. PATENT DOCUMENTS

2009/0078245 A1* 3/2009 Chang ..... A47J 37/0713
126/25 B

FOREIGN PATENT DOCUMENTS

EP 1684015 A1 7/2006
EP 1739351 A1 1/2007

* cited by examiner

GAS VALVE ASSEMBLY

CROSS-REFERENCE TO RELATED APPLICATIONS

This application relates to and claims the benefit and priority to Spanish Utility Model Appl. No. U201330972, filed Aug. 2, 2013.

TECHNICAL FIELD

The present invention relates to assemblies for controlling the flow of gas to gas burners, and more particularly to assemblies comprising an electromagnetic safety valve and a regulating valve.

BACKGROUND

Gas burners comprising a safety valve connected to a main gas inlet which opens or closes, allowing or preventing the passage of said gas, and a thermocouple associated with said safety valve are known. The safety valve is usually closed and needs to be energized to keep it open. The current necessary for energizing the safety valve comes from the thermocouple which generates an electric current that keeps said valve open when it detects a flame. However, while turning the burner on it is necessary to open the safety valve mechanically and keep it open until the flame of the burner lights and the thermocouple generates the electric current necessary to keep the safety valve open.

Gas burners comprising an auxiliary feed circuit providing the safety valve with the energy necessary to keep the safety valve open until the thermocouple is capable of keeping the safety valve open itself are known.

In this sense, EP1739351 A1 discloses a gas burner comprising an electromagnetic safety valve, a thermocouple for energizing the safety valve when there is a flame in the burner, an auxiliary feed circuit for temporarily energizing the safety valve when the burner is activated, and an operating shaft associated with a respective control whereby the rotation of which regulates gas flow. The safety valve is opened by means of an axial movement of the operating shaft.

SUMMARY OF THE DISCLOSURE

According to one implementation a valve assembly is provided that comprises a rotational regulating valve for regulating gas flow to the burner, an electromagnetic safety valve, a thermocouple for energizing the safety valve when there is a flame in the burner, an auxiliary feed circuit for temporarily energizing the safety valve when the burner is activated, and an operating shaft to open the safety valve and to regulate the regulating valve, said safety valve being opened by means of an axial movement of said operating shaft, the operating shaft not being axially movable in any of the angular positions in which the regulating valve is open.

In such valve assemblies of the state of the art, it is possible for the operating shaft to be axially moveable when the regulating valve is in an open position. This means that gas may pass on to the burner in situations in which the gas burner is not working correctly, for example if sparks are not generated due to a power supply failure. In accordance with the assemblies disclosed and contemplated herein, in the process of turning the burner on, the mechanical opening of the safety valve and the opening of the regulating valve are not carried out simultaneously, but rather sequentially. The regulating valve is opened only once the operating shaft has returned to its initial axial position, or stand-by position, and therefore does not act on the safety valve. Therefore, if there is a power supply failure, for example, and sparks are therefore not generated, when the regulating valve is opened, the safety valve will be closed because the auxiliary feed circuit will not energize said safety valve.

According to one implementation an assembly for controlling the flow of a gas to a gas burner is provided that comprises: a gas inlet conduit; a rotational regulating valve for regulating gas flow to the gas burner, the rotational regulating valve rotational between a first angular position corresponding to a closed position in which gas is not permitted to flow through the rotational regulating valve to the gas burner and a second angular position corresponding to an open position in which gas is permitted to flow through the rotational regulating valve to the gas burner; an electromagnetic safety valve situated in a gas flow path between the gas inlet conduit and the rotational regulating valve, the electromagnetic safety valve including a valve member that translates axially between a first axial position corresponding to a closed position in which gas is not permitted to flow through the electromagnetic safety valve and a second axial position corresponding to an open position in which gas is permitted to flow through the electromagnetic safety valve to the rotational regulating valve; a thermocouple adapted for placement near the gas burner and for energizing the electromagnetic safety valve to maintain the valve member in the open position when there is a flame in the burner; an auxiliary feed circuit for temporarily energizing the electromagnetic safety valve to maintain the valve member in the open position; and an operating shaft operably coupled to the rotational regulating valve and to the electromagnetic safety valve, the operating shaft rotatable between angular positions corresponding to the closed and open positions of the rotational regulating valve, the operating shaft axially translatable between axial positions corresponding to the closed and open positions of the valve member of electromagnetic safety valve, axial translation of the operating shaft being prevented when the angular position of the operating shaft corresponds to an open position of the rotational regulating valve, when the operating shaft is in an axial position corresponding to the valve member of the electromagnetic valve being in the open position the auxiliary feed circuit is activated to temporarily energize the electromagnetic safety valve to maintain the valve member in the open position.

These and other advantages and features will become evident in view of the drawings and the detailed description of the invention.

DETAILED DESCRIPTION

Figure 1:
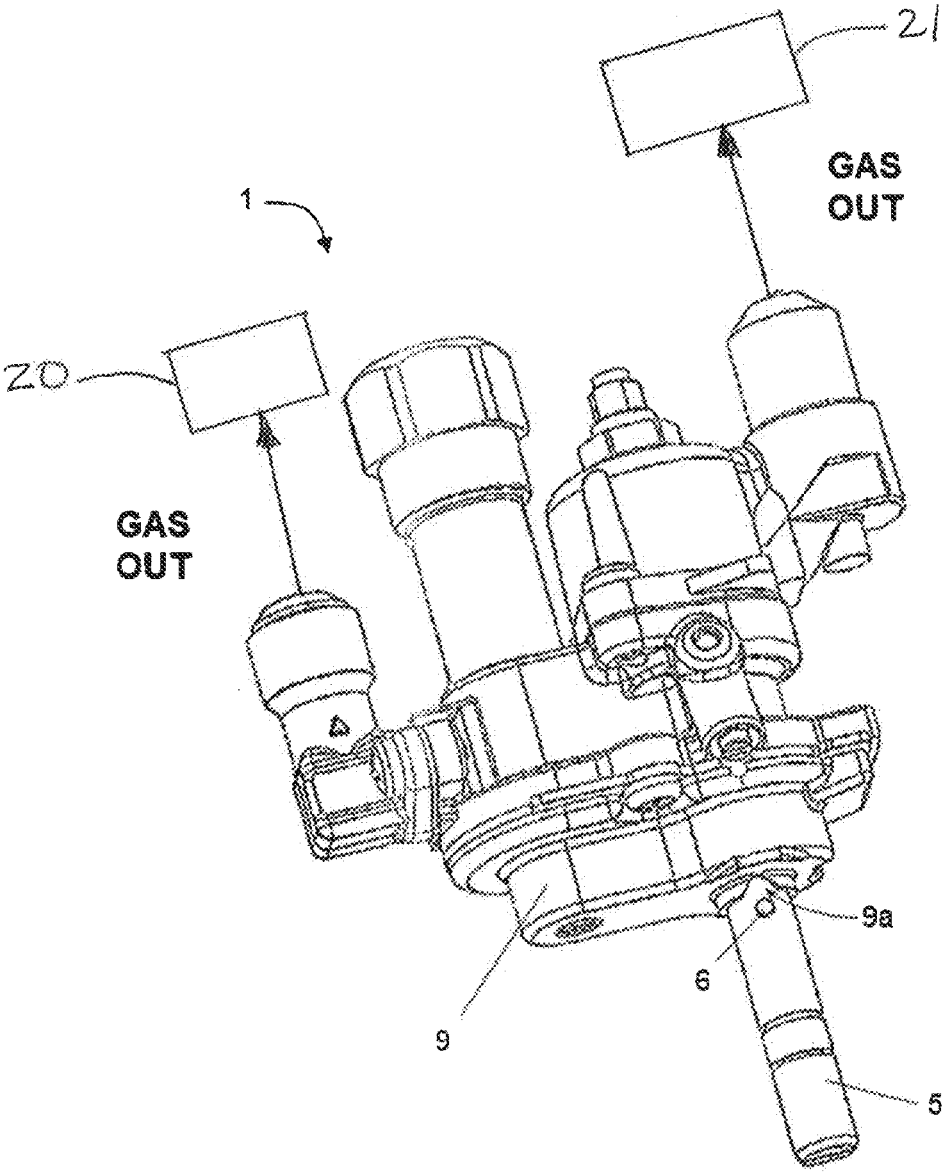
FIG. 1 shows a perspective view of a valve assembly according to an implementation.
Figure 2:
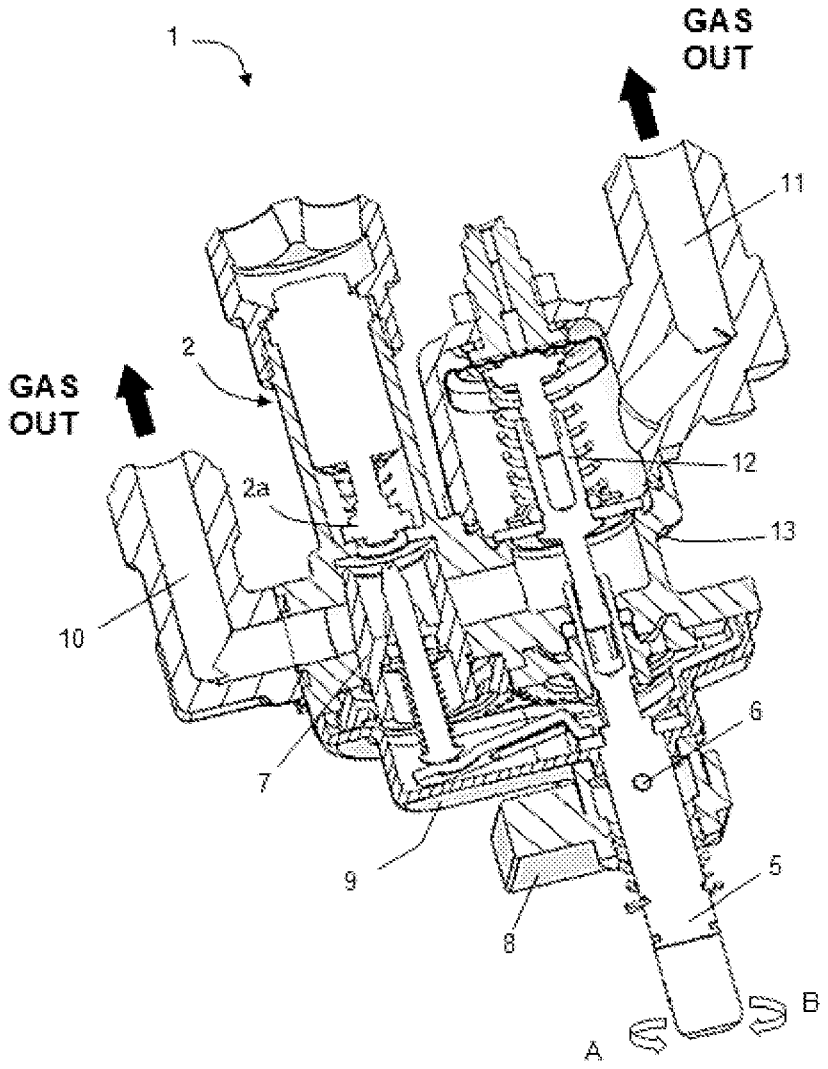
FIG. 2 is a first cross section of the valve assembly of FIG. 1 with an activation switch arranged in the operating shaft.
Figure 3:
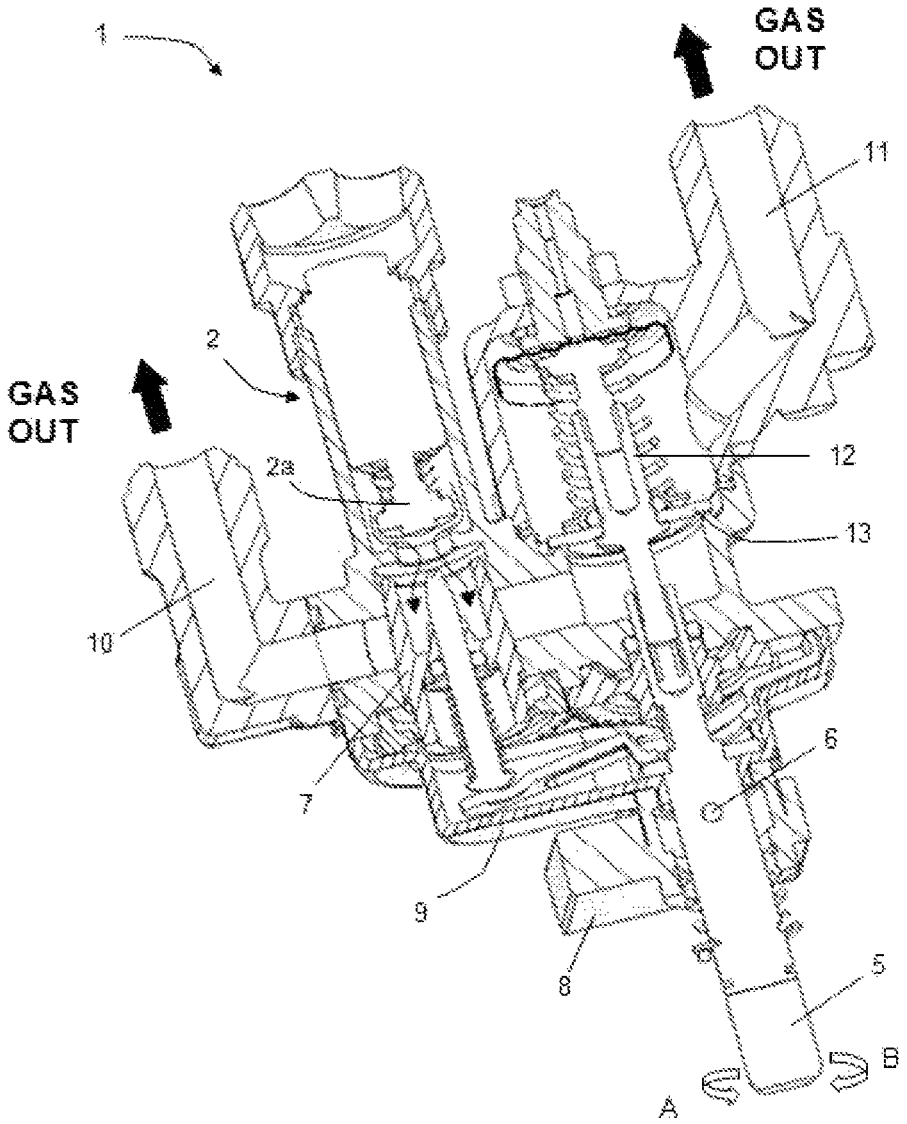
FIG. 3 is a second cross section of the valve assembly of FIG. 1 with the activation switch arranged in the operating shaft.

FIG. 1 shows a valve assembly 1 according to one implementation. The valve assembly 1 comprises an electromagnetic safety valve 2 connected to a main gas inlet, comprising an open position where a valve member 2*a* permits the passage of gas through the safety valve 2, as seen in FIG. 3, and a closed position where the valve member 2*a* is positioned not to permit the passage of gas through the safety valve 2, as seen in FIG. 2. The valve assembly 1 also comprises a rotational regulating valve 7 for regulating gas flow to the burner, a thermocouple 4 for energizing the safety valve 2 when there is a flame in the burner, an auxiliary feed circuit 3 for temporarily energizing the safety valve 2 when the burner is activated, and an operating shaft 5 to open the safety valve 2 and to regulate the regulating valve 7.

The rotational regulating valve 7 regulates the gas flow passing through the safety valve 2 to go to the burner (not shown in the drawings). The regulating valve 7 comprises an "OFF" position where the passage of gas through said regulating valve 7 is not allowed, and "ON" positions where the passage of gas through said regulating valve 7 is allowed. In said "ON" positions, the gas flow rate ranges between a minimum flow rate $Q_{MIN}$ and a maximum flow rate $Q_{MAX}$ depending on the turned angle of the regulating valve 7. The regulating valve 7 is arranged after the safety valve 2 such that the gas from a main gas inlet must first pass through the safety valve 2 before passing through the regulating valve 7. Upon passing through the regulating valve 7, gas flows to an outlet conduit where the burner is arranged.

The operating shaft 5 is rotational and is associated with the regulating valve 7 such that a turn of the shaft 5 also causes a turn in said regulating valve 7. The operating shaft 5 is also axially moveable. Opening of the safety valve 2 is associated with an axial movement of the operating shaft 5. Said shaft 5 has a stand-by position where the shaft 5 is in an axial rest position (i.e., not axially moved) and is not angularly turned with respect to the "OFF" position of the regulating valve 7. The shaft 5 also has an active position where the shaft 5 is axially moved away from the axial rest position and arranged in any angular position in which the regulating valve 7 is closed, preferably in the zero angular position where the regulating valve 7 is in the "OFF" position. The "OFF" position of the regulating valve 7 coincides with the stand-by position of the shaft 5, therefore when the operating shaft has returned to the stand-by position after having been placed in the active position the passage of gas through the regulating valve 7 is not allowed even though the safety valve 2 is open.

In an activation step in which the burner is to be activated, the operating shaft 5 is arranged in said active position to open the safety valve 2 and activate the auxiliary feed circuit 3. In a subsequent turning on step, which will be described in detail below, the burner is turned on when a spark generator is activated, generating the spark that ignites the burner. Therefore, in the valve assembly 1 the activation and the turning on of the burner are different steps that are not carried out simultaneously but rather sequentially. Therefore, if there is power supply failure, for example, and therefore sparks are not generated, when the regulating valve 7 is opened, the safety valve 2 will be closed because the auxiliary feed circuit 3 will not energize said safety valve 2.

The operating shaft 5 also comprises a passage position in which said shaft 5 is arranged in any of the angular positions in which the regulating valve 7 is open, i.e. in the "ON" positions, axial movement of the shaft 5 not being possible when the regulating valve 7 is in on open position. In said passage position, since the regulating valve 7 is in an "ON" position, the passage of gas through said regulating valve 7 is allowed.

The valve assembly 1 can be used in any gas cooking appliance, such as for example in a gas hob or oven. Generally, the valve assembly 1 comprises a gas inlet (not shown in the drawings) and at least one gas outlet conduit (GAS OUT) connected to a burner. The example of FIG. 1 includes a valve assembly 1 for a gas oven comprising a gas inlet (not shown in the drawings) and two gas outlet conduits (GAS OUT), as shown in FIGS. 1, 2, 3, 4 and 5. One of the outlet conduits 10 may be connected with a burner 20 arranged in the top part of the oven, for example what is commonly referred to as grill, and the second outlet conduit 11 may be connected with a burner 21 arranged in the bottom part of the oven.

Figure 4:
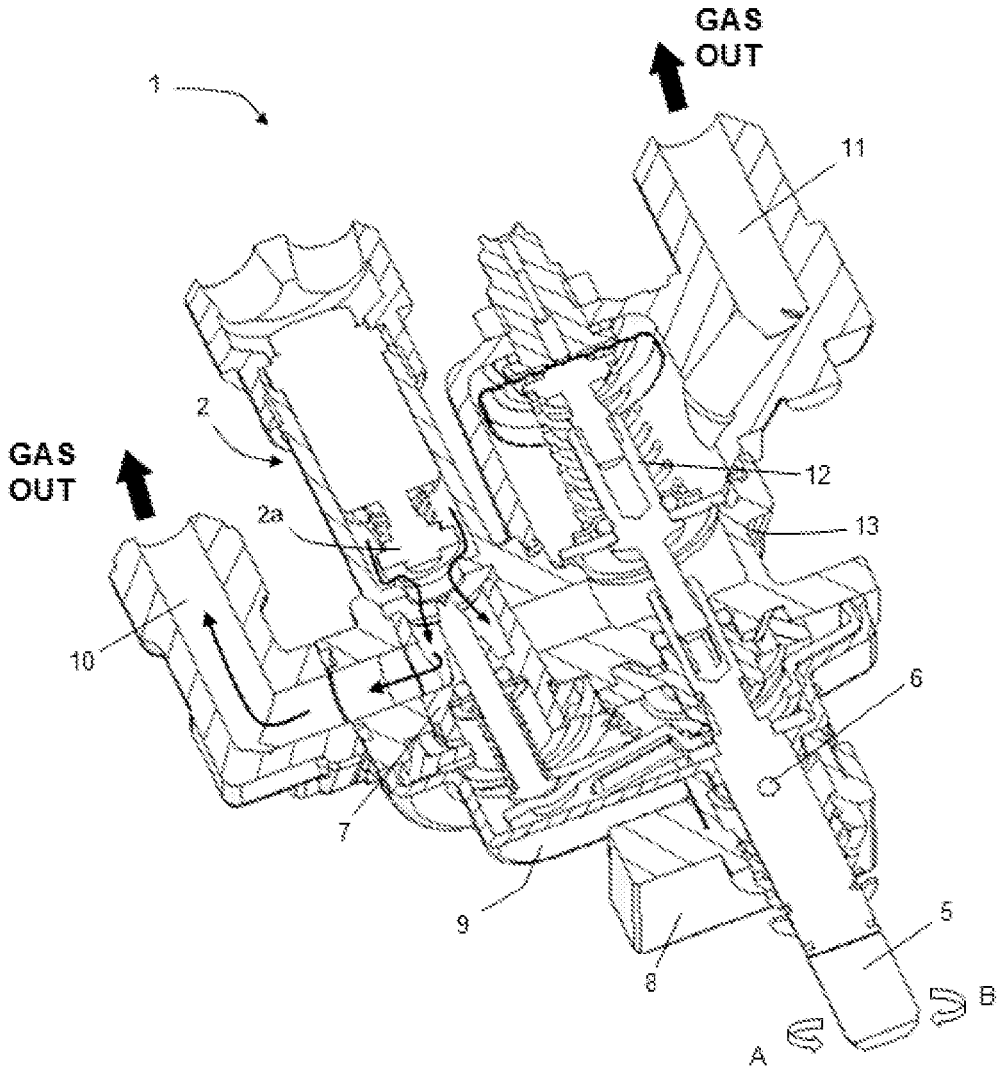
FIG. 4 is a third cross section of the valve assembly of FIG. 1 with the activation switch arranged in the operating shaft.
Figure 5:
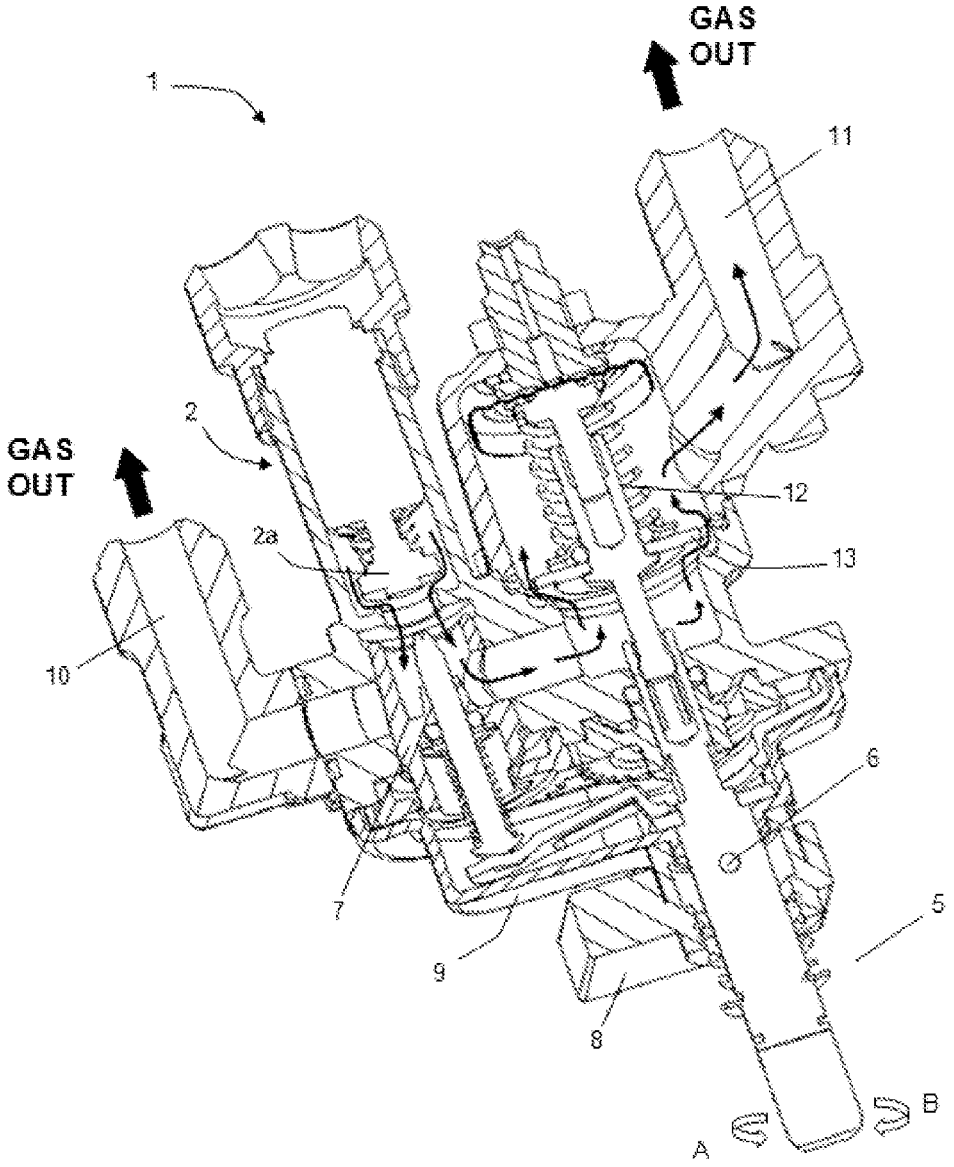
FIG. 5 is a fourth cross section of the valve assembly of FIG. 1 with the activation switch arranged in the operating shaft.
Figure 6:
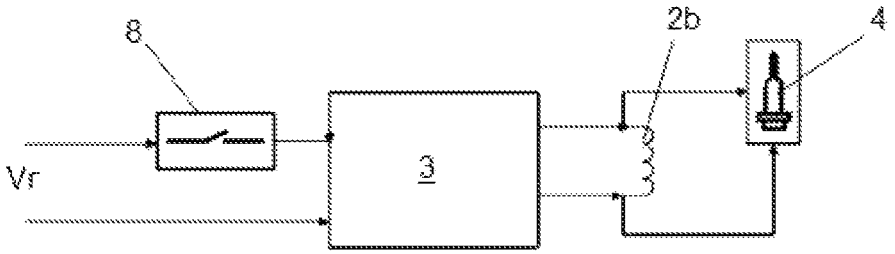
FIG. 6 is a diagram of the circuit for energizing the safety valve of the valve assembly of FIG. 1.

The operating shaft 5 can be moved angularly in two opposite turning directions. Therefore, by turning said shaft 5 in one turning direction "A", the regulating valve 7 turns such that the passage of gas to the first outlet conduit 10 is opened, as seen in FIG. 4, changing the gas flow according to the turned angle. If in contrast the shaft 5 turns in opposite direction "B", the regulating valve 7 turns such that the passage of gas to the second outlet conduit 11 is opened, as seen in FIG. 5, changing the gas flow according to the turned angle.

A thermostatic valve 12 helping to keep the temperature of the oven stable and comprising a sealing disc 13 may be arranged between the regulating valve 7 and the second outlet conduit 11. In such implementations, the operating shaft 5 and the thermostatic valve 12 are associated such that the angular movement of said operating shaft 5 to open the passage of gas to the second outlet conduit 11 causes the sealing disc 13 to move axially, opening the passage of gas to the second outlet conduit 11. Said thermostatic valve 12 comprises a capillary (not shown in the drawings) that opens more or less said sealing disc 13 according to the temperature of the oven to keep the temperature of the oven cavity stable.

In case that the valve assembly 1 was arranged in a gas hob, the thermostatic valve 12 would not be necessary. In this case, the valve assembly 1 could have a single outlet conduit connected to the crown of the burner, or two outlet conduits each connected with a crown of the burner.

If the flame does not light when turning the burner 1 on, after a pre-established time the auxiliary feed circuit 3 stops feeding the safety valve 2, and since the thermocouple 4 does not detect flame it does not energize said safety valve 2, therefore, the safety valve 2 will close, preventing the passage of gas. To reset or open the safety valve 2 again, the operating shaft 5 must be returned to the stand-by position, i.e., the regulating valve 7 must be closed, putting it in the "OFF" position, so that the shaft 5 can go to the activation position. It therefore prevents the safety valve 2 from being able to open when the regulating valve 7 is in the "ON" position. The risk of an unburned gas leak is therefore prevented, increasing the safety of the burner in a simple and efficient way. The safety valve 2 can only be reset, i.e., go from closed to open, when the regulating valve 7 is closed so that said burner turns on in a safe and controlled manner.

Therefore, in the valve assembly 1 it is not possible for the operating shaft 5 to go from the passage position to the activation position without going through the stand-by position, i.e., it is not possible to axially move the shaft 5, said shaft 5 being turned with respect to the "OFF" position of the regulating valve 7 where the passage of gas through said regulating valve 7 is allowed, until said shaft 5 is arranged in the angular starting, or zero, position where the passage of gas through said regulating valve 7 is not allowed.

In the example of FIG. 1, the activation position of the operating shaft 5 is accessible in a single angular position such that said shaft 5 is axially movable only when in a single angular position, said angular position corresponding with the "OFF" position of the regulating valve 7. Therefore, in said position the passage of gas through the regulating valve 7 is not allowed even if the safety valve 2 is open.

According to some implementations the operating shaft 5 comprises a stud 6 projecting radially from the shaft 5, and the valve assembly 1 comprises a cover 9 with a stop surface for said stud 6, said cover 9 comprising a groove 9*a*, preferably V-shaped, allowing the axial movement of the operating shaft 5 when the shaft 5 is in an angular position corresponding to the "OFF" position of the regulating valve 7. When the shaft 5 is arranged in the passage position, the stud 6 interacts with the stop surface of the cover 9, preventing the shaft 5 from being able to be axially moved in said position.

In the process of turning the burner on, the safety valve 2 is activated in the activation step, as discussed above, the operating shaft 5 going from the stand-by position to the active position, a position in which the auxiliary feed circuit 3 is activated through an activation switch 8. Said switch 8 is associated with the operating shaft 5 and with the auxiliary circuit 3, such that the axial movement of said shaft 5 closes said switch 8, thereby activating the auxiliary feed circuit 3. Said auxiliary circuit 3 temporarily energizes one or more coils 2*b* of the safety valve 2 to maintain the valve member 2*a* in an open position, it not being necessary to keep the shaft 5 moved in order to keep the safety valve 2 open. Therefore, once the burner is activated the shaft 5 returns to the stand-by position. Said auxiliary feed circuit 3 keeps the safety valve 2 open long enough until the thermocouple 4 is able to energize the safety valve 2 by itself. To that end, the thermocouple 4 must detect flame in the burner and it must be heated enough to generate electric current feeding said safety valve 2.

Figure 7A:
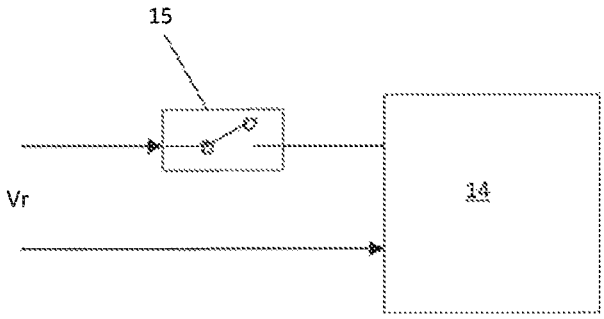
FIG. 7A is a diagram of the activation switch and spark generator with the activation switch being in the open position.
Figure 7B:
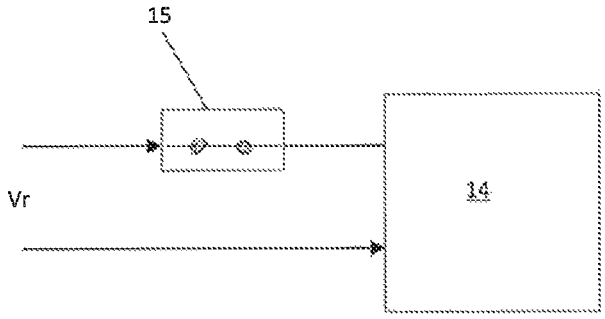
FIG. 7B is a diagram of the activation switch and spark generator with the activation switch being in the closed position.
Figure 8:
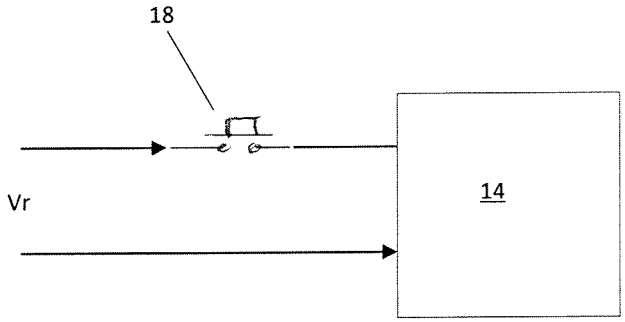
FIG. 8 is a diagram of the activation button and spark generator.

In the turning on step which is carried out after the activation step, the operating shaft 5 is arranged in the passage position where the passage of gas through the regulating valve 7 to the burner is allowed. The valve assembly 1 may comprise an ignition switch 15, as shown in FIGS. 7A and 7B, which is associated with the operating shaft 5 and also comprises a spark generator 14, such that the angular movement of said shaft 5 away from the OFF position of the regulating valve 7 closes said ignition switch 15, thus activating the spark generator 14 automatically. FIG. 7A is a diagram of the ignition switch 15 and the spark generator 14 when the operating shaft 5 is in the OFF angular position, the ignition switch 15 being in the open position. FIG. 7B is a diagram of the ignition switch 15 and the spark generator 14 when the operating shaft 5 is in the ON angular position, the ignition switch 15 being in the closed position. Instead of the ignition switch, the valve assembly 1 may optionally comprise an ignition button 18, as shown in FIG. 8, associated with the spark generator 14, such that when the operating shaft 5 is turned with respect to the "OFF" position of the regulating valve 7 said ignition button 18 is enabled to be pressed and thus activate the spark generator 14 manually.

Regardless of if the spark generator is activated automatically or manually, the burner is turned on in a safe, controlled and efficient manner. The spark generator is activated after opening the passage of gas through the regulating valve 7, and more specifically when it is assured that enough gas reaches the burner to assure that the flame will be lit shortly after the spark is generated, failed attempts at turning it on therefore being prevented. Furthermore, even though it is not possible to light the flame of the burner, for example due to a failure in the spark generator, there will be no unburned gas leak because the safety valve 2 will be closed when the auxiliary feed circuit 3 is disconnected since the safety valve 2 will not be energized by the thermocouple 4, and since it is not possible to axially move the operating shaft 5 in the passage position of said shaft 5, then it is not possible to accidentally open the safety valve 2 to allow the passage of gas to the burner.

Based on the valve assembly 1 it is possible to obtain a gas cooking appliance, such as a gas hob or oven for example, that comprises a plurality of valve assemblies 1 such as those disclosed herein.

What is claimed is:

1. An assembly for controlling the flow of a gas to a gas burner comprising:

a gas inlet conduit, a rotational regulating valve for regulating gas flow to the gas burner, the rotational regulating valve being rotational between a first angular position corresponding to a closed position in which gas is not permitted to flow through the rotational regulating valve to the gas burner and a second angular position corresponding to an open position in which gas is permitted to flow through the rotational regulating valve to the gas burner, an electromagnetic safety valve situated in a gas flow path between the gas inlet conduit and the rotational regulating valve, the electromagnetic safety valve including a valve member that translates axially between a first axial position corresponding to a closed position in which gas is not permitted to flow through the electromagnetic safety valve and a second axial position corresponding to an open position in which gas is permitted to flow through the electromagnetic safety valve to the rotational regulating valve, a thermocouple adapted for placement near the gas burner and for energizing the electromagnetic safety valve to maintain the valve member in the open position when there is a flame in the burner, an auxiliary feed circuit for temporarily energizing the electromagnetic safety valve to maintain the valve member in the open position, an operating shaft operably coupled to the rotational regulating valve and to the electromagnetic safety valve, the operating shaft being rotatable between an OFF angular position and an ON angular position, the OFF angular position corresponding to the closed position of the rotational regulating valve, the ON angular position corresponding to the open position of the rotational regulating valve, the operating shaft axially translatable between a first axial position and a second axial position, the first axial position corresponding to the closed position of the valve member of electromagnetic safety valve, the second axial position corresponding to the open position of the valve member of electromagnetic safety valve, when the operating shaft is in the ON angular position the operating shaft is in the first axial position and is prevented from being moved from the first axial position to the second axial position, when the operating shaft is in the second axial position corresponding to the valve member of the electromagnetic valve being in the open position the auxiliary feed circuit is activated to temporarily energize the electromagnetic safety valve to maintain the valve member in the open position, the operating shaft being axially translatable between the first and second axial positions only when the operating shaft is in the OFF angular position, a spark generator, an activation switch associated with the operating shaft, when the operating shaft is in the second axial position corresponding to the valve member of the electromagnetic valve being in the open position the activation switch is closed to activate the auxiliary feed circuit, when the activation switch is closed to activate the auxiliary feed circuit the spark generator is not activated: and an ignition switch associated with the operating shaft, wherein the angular movement of the operating shaft from the OFF angular position corresponding to the closed position of the rotational regulating valve to the ON angular position corresponding to an open position of the rotational regulating valve closes the ignition switch to activate the spark generator while the auxiliary feed circuit is activated.

2. The assembly according to claim 1, wherein the rotational regulating valve and electromagnetic safety valve are disposed in a common housing, the operating shaft including a radially projecting stud, the housing comprising a cover with a recess for receiving the radially projecting stud to allow axial movement of the operating shaft between the first and second axial positions when the operating shaft is in the OFF angular position corresponding to the closed position of the rotational regulating valve, when the operating shaft is in the ON angular position corresponding to an open position of the rotational regulating valve a surface of the cover interfaces with the radially projecting stud of the operating shaft to prevent axial movement of the operating shaft from the first axial position to the second axial position.

3. An assembly for controlling the flow of a gas to a gas burner comprising:

a gas inlet conduit, a rotational regulating valve for regulating gas flow to the gas burner, the rotational regulating valve being rotational between a first angular position corresponding to a closed position in which gas is not permitted to flow through the rotational regulating valve to the gas burner and a second angular position corresponding to an open position in which gas is permitted to flow through the rotational regulating valve to the gas burner, an electromagnetic safety valve situated in a gas flow path between the gas inlet conduit and the rotational regulating valve, the electromagnetic safety valve including a valve member that translates axially between a first axial position corresponding to a closed position in which gas is not permitted to flow through the electromagnetic safety valve and a second axial position corresponding to an open position in which gas is permitted to flow through the electromagnetic safety valve to the rotational regulating valve, a thermocouple adapted for placement near the gas burner and for energizing the electromagnetic safety valve to maintain the valve member in the open position when there is a flame in the burner, an auxiliary feed circuit for temporarily energizing the electromagnetic safety valve to maintain the valve member in the open position, an operating shaft operably coupled to the rotational regulating valve and to the electromagnetic safety valve, the operating shaft being rotatable between an OFF angular position and an ON angular position, the OFF angular position corresponding to the closed position of the rotational regulating valve, the ON angular position corresponding to the open position of the rotational regulating valve, the operating shaft axially translatable between a first axial position and a second axial position, the first axial position corresponding to the closed position of the valve member of electromagnetic safety valve, the second axial position corresponding to the open position of the valve member of the electromagnetic safety valve, when the operating shaft is in the ON angular position the operating shaft is in the first axial position and is prevented from being moved from the first axial position to the second axial position, when the operating shaft is in the second axial position corresponding to the valve member of the electromagnetic valve being in the open position the auxiliary feed circuit is activated to temporarily energize the electromagnetic safety valve to maintain the valve member in the open position: and an ignition button associated with a spark generator, the button being enabled so that it can be pressed to activate the spark generator only when the operating shaft is in an angular position corresponding to the open position of the rotational regulating valve.

* * * * *